US008574415B2

(12) United States Patent
Wu et al.

(10) Patent No.: US 8,574,415 B2
(45) Date of Patent: Nov. 5, 2013

(54) METHOD OF FORMING SINGLE-LAYER PHOTONIC CRYSTAL STRUCTURE

(75) Inventors: Pu-Wei Wu, Hsinchu (TW); Yi-Jui Huang, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 291 days.

(21) Appl. No.: 13/051,232

(22) Filed: Mar. 18, 2011

(65) Prior Publication Data

US 2012/0138466 A1 Jun. 7, 2012

(30) Foreign Application Priority Data

Dec. 3, 2010 (TW) ..... 99142075 A

(51) Int. Cl.
*C25D 13/02* (2006.01)

(52) U.S. Cl.
USPC ..... 204/490; 204/491

(58) Field of Classification Search
USPC ..... 204/490, 491
See application file for complete search history.

(56) References Cited

U.S. PATENT DOCUMENTS 6,846,578 B2 * 1/2005 Kumacheva et al. ..... 428/612

OTHER PUBLICATIONS

Huang et al., "Fabrication of Colloidal Crystals and Their Inverse Opals for Engineering Applications", Published Jul. 26, 2010.

* cited by examiner

*Primary Examiner* — Kishor Mayekar
(74) *Attorney, Agent, or Firm* — Edwards Wildman Palmer LLP; Peter F. Corless; Richard B. Emmons

(57) ABSTRACT

A method of forming a single-layer photonic crystal structure. The method includes depositing electrophoretic suspension, working electrode and lower electrode in a container, wherein the working electrode and the lower electrode are formed at upper and lower parts of the container, respectively, and spaced apart at an distance; and applying an electric voltage to the working electrode and the lower electrode to form an electric field, such that particles in the electrophoretic suspension form a single-layer photonic crystal structure on the working electrode under interactive actions of the electric field and a gravity field by an electrophoresis self-assembly technique. Therefore, the single-layer photonic crystal structure has a low cost, and good quality and recurring property.

8 Claims, 7 Drawing Sheets

METHOD OF FORMING SINGLE-LAYER PHOTONIC CRYSTAL STRUCTURE

CROSS-REFERENCES TO RELATED APPLICATIONS

This application claims under 35 U.S.C. §119(a) the benefit of Taiwanese Application No. 99142075, filed Dec. 3, 2010, the entire contents of which is incorporated herein by reference.

BACKGROUND OF THE INVENTION

1. Field of the Invention

This invention relates to methods of forming photonic crystal structures, and, more particularly, to a method of forming a single-layer photonic crystal structure.

2. Description of Related Art

A half century ago, physicists came to understand that electrons in a crystal will be affected by periodical potential scattering in a lattice of the crystal, and thus have a band-distributed dispersion relation (i.e., an electronic band structure), because some wave segments form an energy gap as a result of destructive interferences. Similarly, a photon system may suffer this phenomenon. In a dielectric material that has a periodically arranged dielectric coefficient, magnetic waves, after scattered by a dielectric function, have some wave segments that have magnetic wave intensity decaying exponentially as a result of destructive interferences, and cannot be transmitted in a photon system. Such a phenomenon is equivalent to forming an energy gap on a frequency spectrum, which indicates that the dispersion relation also has a band structure, which is called a photonic band structure. A dielectric material that has a photonic band structure is called a photonic band-gap system or is called a photonic crystal, in brief. The photonic crystal has been discovered for more than 20 years, but does not have significant development until the year of 2,000. Different from an ordinary dielectric material, the photonic crystal features in its complicated dispersion relation.

The photonic crystal may be applied to a variety of photoelectric elements, such as adjustable semiconductor laser, photo routers, high-efficiency photo amplifiers, multiplexers, variable gain balancers, adjustable narrow bandpass gratings, circulators, low-loss curved waveguides, high-efficiency switches, add/sub filters, and highly sensitive sensors. Specifically, if some defects are arranged in a periodically arrangement on purpose, some narrow photon penetrating channels may be generated within an energy gap range of a photonic crystal, and many new, strange phenomenon is derived and may be applied to elements.

However, a single-layer photonic crystal structure generated by a coating method faces a poor arrangement and has arrangement quality that is difficult to be controlled. As shown in FIGS. 1A and 1B is a microscope topography picture of a single-layer photonic crystal structure that is generated by a coating method according to the prior art. It is shown in FIG. 1A that a single-layer photonic crystal 1 has a non-uniform structure. It is more clear from FIG. 1B, which shows the single-layer photonic crystal 1 in 10 μm/unit length scale, that no periodic structure that is compactly arranged is formed between the single-layer photonic crystal 1. As described previously, a photonic crystal structure has to have a periodically arranged structure, in order to be applied to elements. A photonic crystal structure, if having no periodically arranged structure, may have a limited number of applications. Since the coating process is difficult to be controlled, the single-layer photonic crystal structure has poor quality. Moreover, the equipment needed for implementing the process is very expensive. Accordingly, the single-layer photonic crystal structure has a high fabrication cost.

Therefore, how to develop a new generation of a method of forming a single-layer photonic crystal structure that has high recurring property, high quality and low cost is becoming one of the most popular issues in the art.

SUMMARY OF THE INVENTION

In view of the above-mentioned problems of the prior art, the present invention provide a method of forming a single-layer photonic crystal structure. The method includes the following steps of: (1) depositing electrophoretic suspension, a working electrode and a lower electrode in a container, wherein the working electrode and the lower electrode are respectively formed on an upper part and a lower part of the container, and spaced apart from each other at an distance; and (2) applying an electric voltage to the working electrode and the lower electrode to form an electric field, such that particles in the electrophoretic suspension form the single-layer photonic crystal structure on the working electrode under interactive actions of the electric field and a gravity field by an electrophoresis self-assembly technique.

In an embodiment of the present invention, step (1) further includes disposing between the working electrode and the lower electrode a template having apertures, and step (2) further comprises rendering the particles in the electrophoretic suspension to penetrate the apertures under the interactive actions of the electric field and the gravity field, to form the single-layer photonic crystal structure on a certain portion of the working electrode.

Compared with the prior art, the method of forming a single-layer photonic crystal structure according to the present invention uses the interactive actions of the electric field and the gravity field to render the particles in the electrophoretic suspension to form on the working electrode a self-assembled single-layer photonic crystal structure slowly. Therefore, the problems of the prior art that the fabrication process is difficult to be controlled and the photonic crystal structure has poor recurring property and assembly quality.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Figure 2A:
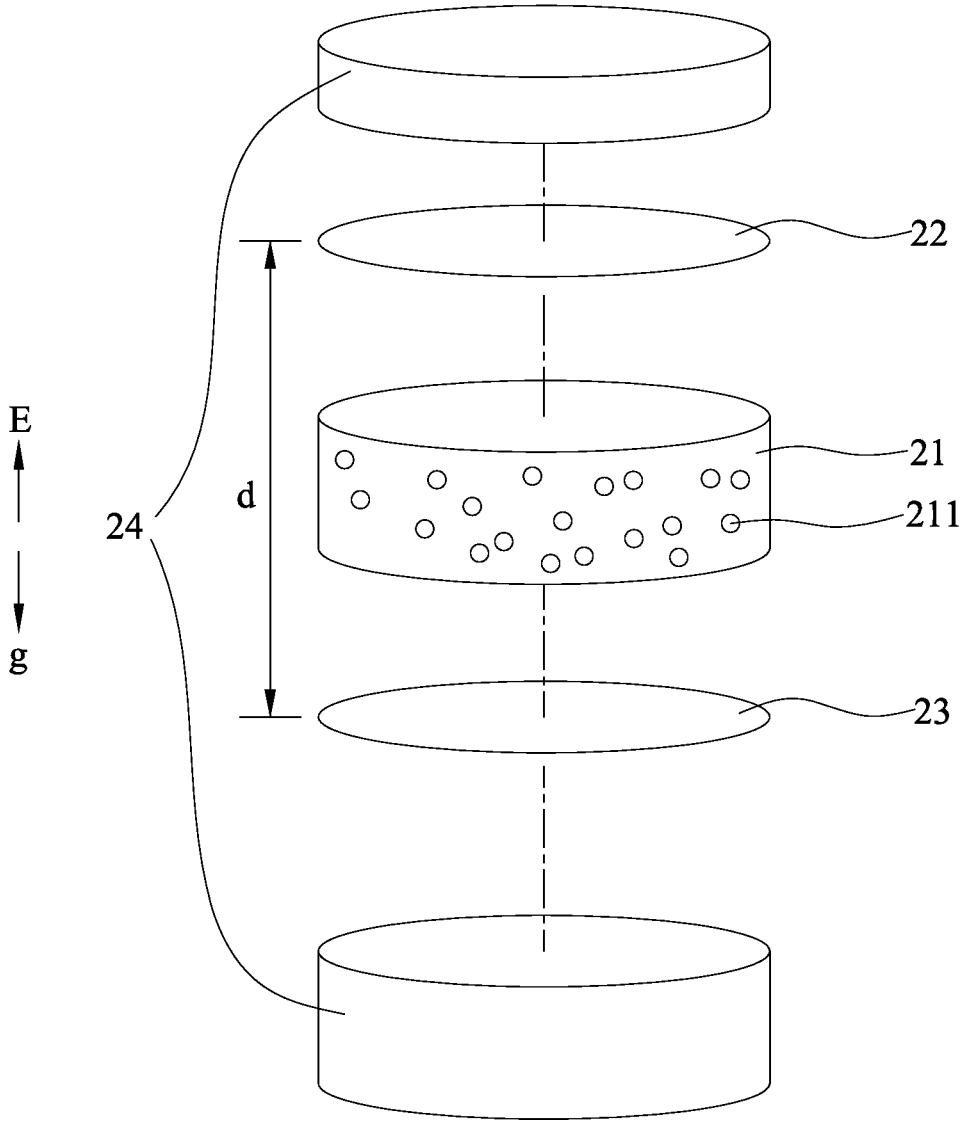
FIG. 2A is a schematic diagram illustrating a step of a method of forming a single-layer photonic crystal structure according to the present invention.
Figure 2B:
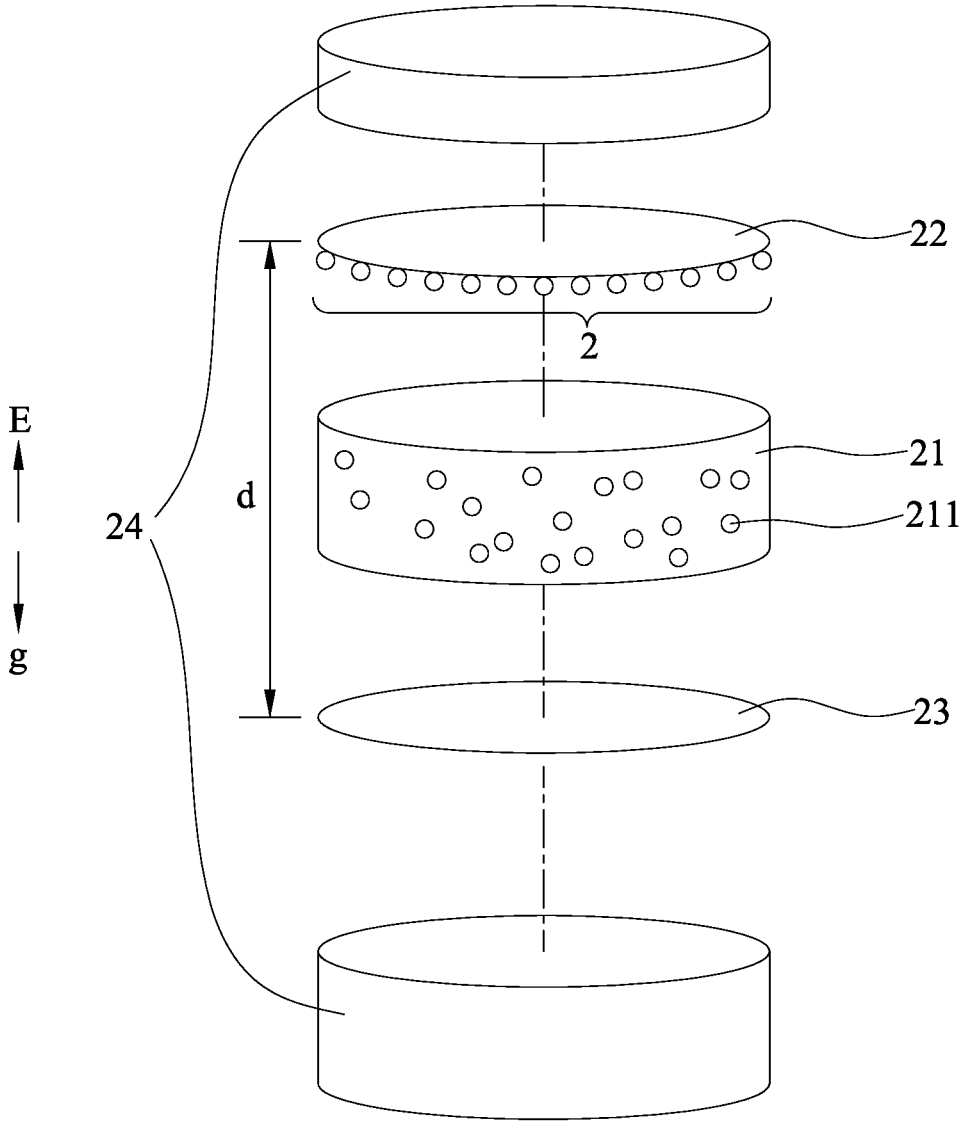
FIG. 2B is a schematic diagram illustrating another step of a method of forming a single-layer photonic crystal structure according to the present invention.

FIGS. 2A and 2B are schematic diagrams illustrating steps of a method of forming a single-layer photonic crystal structure according to the present invention. Electrophoretic suspension 21, a working electrode 22 and a lower electrode 23 are disposed in a container 24, and the working electrode 22 and the lower electrode 23 are formed on an upper part and a lower part of the container 24, respectively. An electric voltage is then applied to the working electrode 22 and the lower electrode 23 to form an electric field E, such that particles 211 in the electrophoretic suspension 21 form a single-layer photonic crystal structure 2 on the working electrode 22, as shown in FIG. 2B, under interactive actions of the electric field E and a gravity field g by an electrophoresis self-assembly technique as detailed below.

After the single-layer photonic crystal structure 2 is formed on the working electrode 22, the working electrode 22 on which the single-layer photonic crystal structure 2 is formed, is taken out from the electrophoretic suspension, and disposed in a surrounding in which humidity and temperature are controlled, such that the closest packing quality of the single-layer photonic crystal structure 2 can be adjusted. For example, a steam nozzle may be used to spray steam in the surrounding to increase the humidity, such that the single-layer photonic crystal structure 2 has better closest packed quality. In addition to the humidity and temperature of the surrounding, a drying speed of the working electrode 22 can also be controlled, such that the compactness of the single-layer photonic crystal structure 2 can be adjusted.

In the method of forming a single-layer photonic crystal structure according to the present invention, the particles 211 in the electrophoretic suspension 21 are self-assembled by an electrophoretic effect, and have a self-assembly speed that is adjustable according to the distance d between the working electrode 22 and the lower electrode 23, an intensity of the electric field E, concentration of the electrophoretic suspension 21 or components of the electrophoretic suspension 21. Therefore, the "single-layer" photonic crystal structure that has a high yield, high quality and high recurring property may be formed on the working electrode. In practice, the particles are influenced by the electric field E to move toward the working electrode 22 that is disposed on the upper part of the container 24, while the gravity field g influences the particles 211 to move toward the lower electrode 23 that is disposed on the lower part of the container 24. Interactive actions of the electric field E and the gravity field g may greatly reduce the self-assembly speed of the particles 211. Therefore, engineers are allowed to form a layer of photonic crystal structure on the working electrode 22 precisely. In an embodiment of the present invention, the distance d between the working electrode 22 and the lower electrode 23 may be greater than 0.5 cm, the intensity of the electric field E may be between 1 V/cm and 100 V/cm, and the concentration of the electrophoretic suspension 21 may be in a range from 0.0001 g/ml to 0.1 g/ml.

Figure 1A:
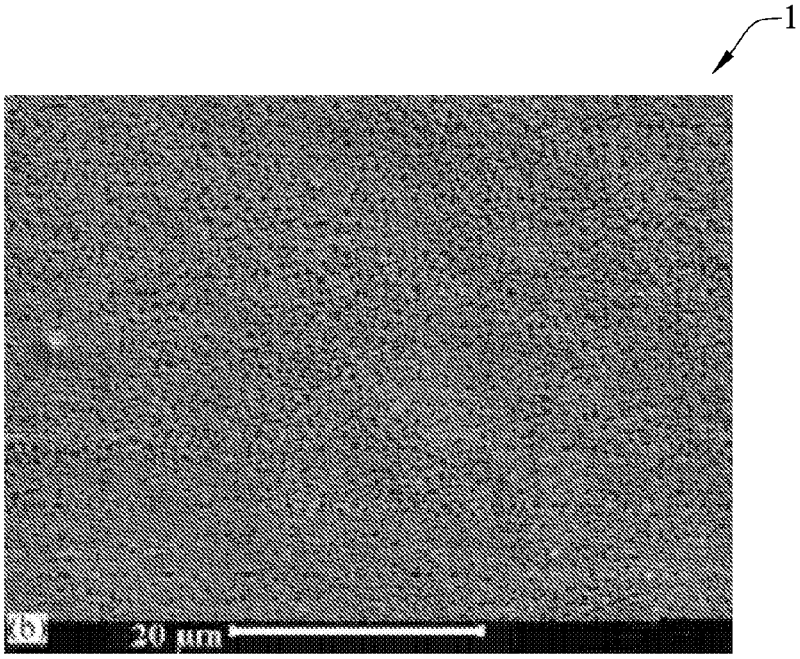
FIG. 1A (PRIOR ART)
FIG. 1A is a microscope topography picture, in a 20 μm/unit length scale, of a single-layer photonic crystal structure formed by a coating method according to the prior art.
Figure 1B:
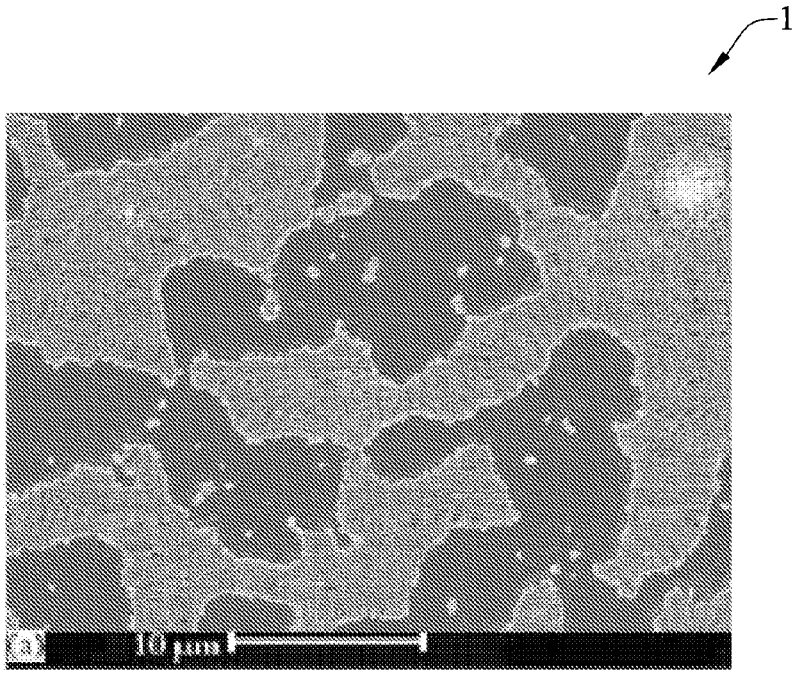
FIG. 1B (PRIOR ART)
FIG. 1B is a microscope topography picture, in a 10 μm/unit length scale, of a single-layer photonic crystal structure formed by a coating method according to the prior art.
Figure 3:
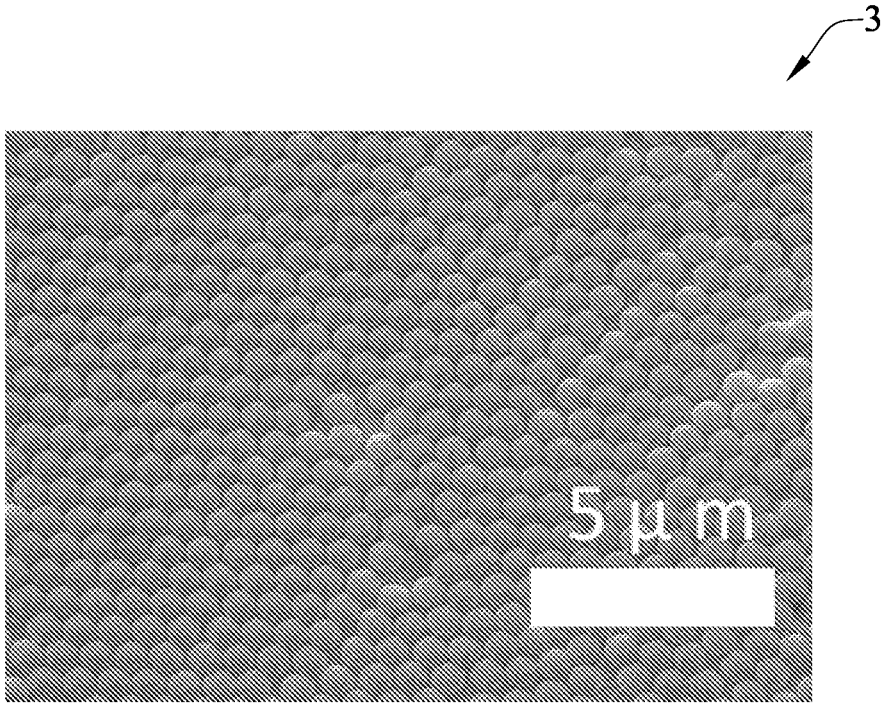
FIG. 3 is a microscope topography picture, in a 5 μm/unit length scale, of a single-layer photonic crystal structure formed by a method of forming a single-layer photonic crystal structure according to the present invention.

FIG. 3 is a microscope topography picture, in a 5 μm/unit length scale, of a single-layer photonic crystal structure 3 formed by a method of forming a single-layer photonic crystal structure according to the present invention. Compared with the single-layer photonic crystal structure formed by the coating method according to the prior art, as shown in FIGS. 1A and 1B, the single-layer photonic crystal structure 3 has better quality and is arranged more compactly. Most importantly, the single-layer photonic crystal structure that is formed by the electrophoresis self-assembly technique according to the present invention has a periodically arranged closest packed structure, which, however, cannot be realized by the coating method according to the prior art. Besides, the present invention overcomes the problem in the art that the conventional electrophoresis self-assembly technique cannot control a single-layer self-assembly.

Figure 4A:
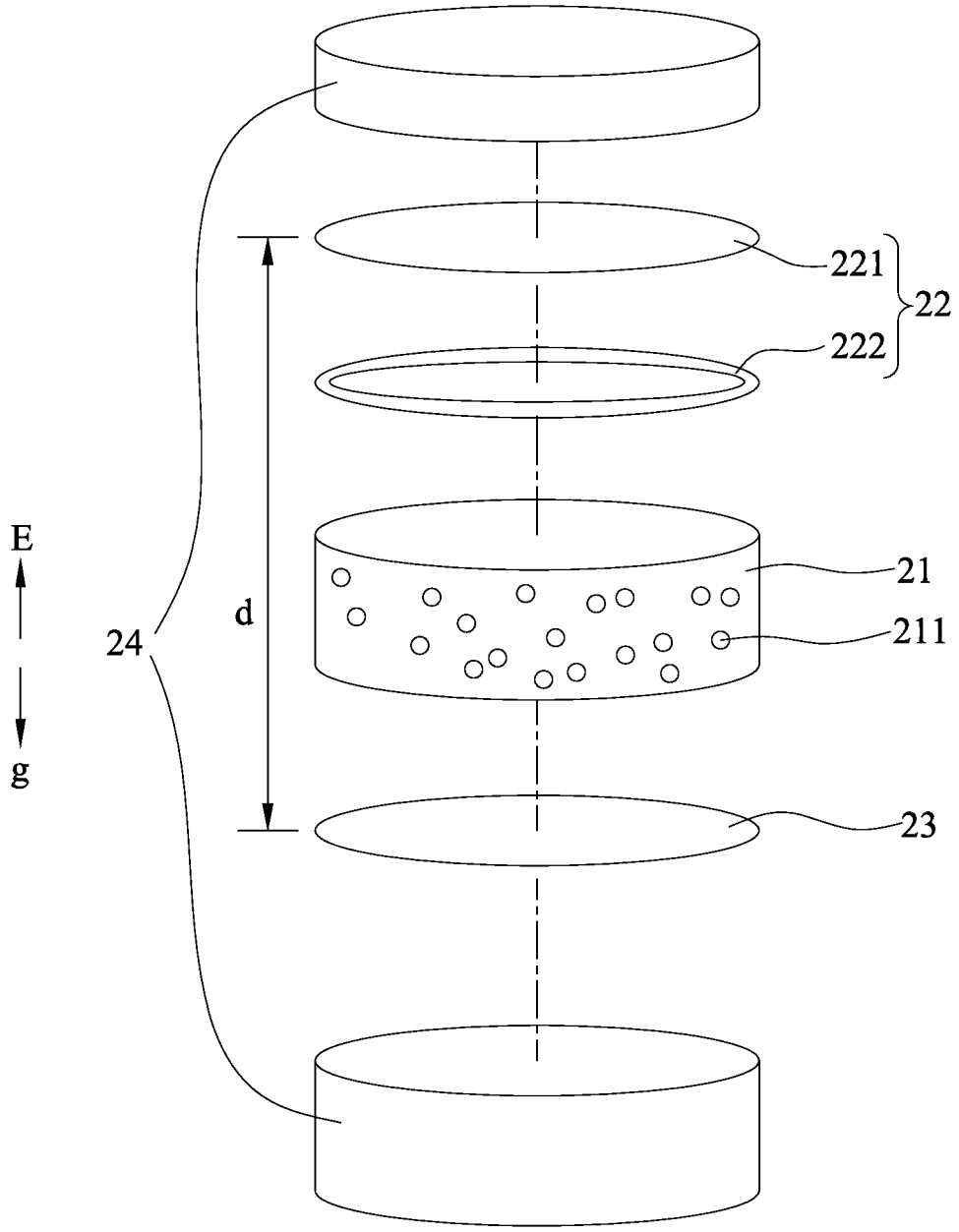
FIG. 4A is a schematic diagram illustrating a step of assembling a wafer and a ring electrode to act as a working electrode shown in FIG. 2A.

FIG. 4A is a schematic diagram illustrating a step of assembling a wafer 221 and a ring electrode 222 to act as the working electrode 22 shown in FIG. 2A. The working electrode 22 comprises the wafer 221 and the ring electrode 222. The single-layer photonic crystal structure may be formed on the wafer 221, to act as an etch mask, LED or solar battery. The ring electrode 222 may be in the shape of a ring or a polygon, such as a square, a rectangle and a triangle, according to demands of users.

Figure 4B:
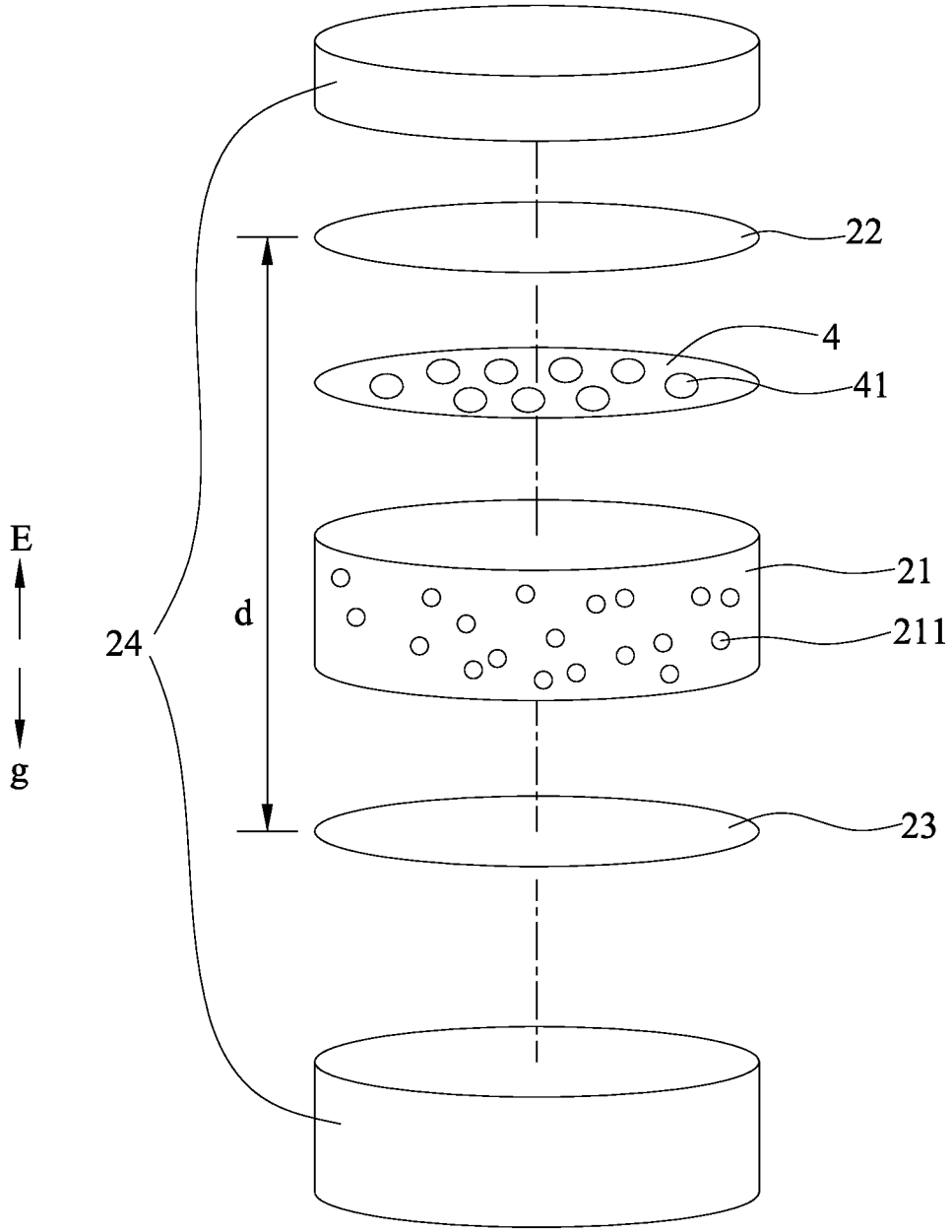
FIG. 4B is a schematic diagram illustrating a step of disposing a template between the working electrode and a lower electrode shown in FIG. 2A.
Figure 4C:
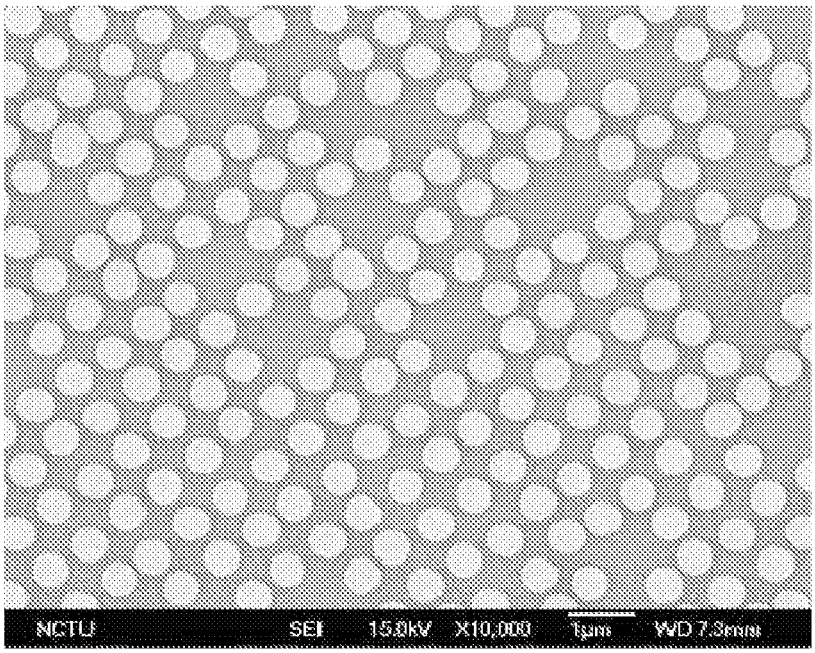
FIG. 4C is a microscope topography picture of a periodically arranged non-closest packed photonic crystal structure by the steps shown in FIG. 4B.

Referring to FIG. 4B, a template 4 having apertures 41 is disposed between the working electrode 22 and the lower electrode 23. Accordingly, the particles 211 in the electrophoretic suspension 21 are allowed to penetrate, under the interactive actions of the electric field E and the gravity field g, the apertures 41 of the template 4, to form a single-layer photonic crystal structure on a certain portion of the working electrode 22. No single-layer closest packed photonic crystal structure will be formed on remaining portions of the working electrode 22 corresponding to a portion of the template 4 where the apertures 41 are not formed, because the particles 211 are blocked by the portion of the template 4 when the electrophoretic effect is generated. Accordingly, a single-layer photonic crystal structure that is in another periodic arrangement (non-closest packed arrangement) is fabricated, as shown in FIG. 4C.

In sum, a method of forming a single-layer photonic crystal structure according to the present invention, may form particles on a working electrode precisely, through the disposition of a gravity field and an electric field and the adjustment for components of an electrophoretic suspension and parameters of a surrounding in which the working electrode is disposed, so as to form a single-layer photonic crystal structure. The method of forming a single-layer photonic crystal structure according to the present invention may have the following advantages: (1) the photonic crystal structure that is formed by an electrophoresis self-assembly technique is more compact than a photonic crystal structure formed by a coating method according to the prior art; (2) the single-layer photonic crystal structure may be formed on the working electrode precisely by controlling a self-assembly speed under interactive actions of the gravity field and the electric field, so as to solve the problem of the prior art that a conventional electrophoresis technique cannot control a single-layer self-assembled photonic crystal; and (3) the electrophoresis technique according to the present invention does not need expensive process apparatuses, and may reduce the fabrication cost of the single-layer photonic crystal structure.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A method of forming a single-layer photonic crystal structure, comprising the following steps of:

(1) depositing electrophoretic suspension, a working electrode and a lower electrode in a container, wherein the working electrode and the lower electrode are respectively formed on an upper part and a lower part of the container, and spaced apart from each other at a distance; and (2) applying an electric voltage to the working electrode and the lower electrode to form an electric field, such that particles in the electrophoretic suspension form the single-layer photonic crystal structure on the working electrode under interactive actions of the electric field and a gravity field by an electrophoresis self-assembly technique, wherein step (1) further comprises disposing between the working electrode and the lower electrode a template having apertures, and step (2) further comprises rendering the particles to penetrate the apertures of the template under the interactive actions of the electric field and the gravity field, to form the single-layer photonic crystal structure on a certain portion of the working electrode.

2. The method of claim 1, further comprising step (3) of taking the working electrode, on which the single-layer photonic crystal structure is formed, out from the electrophoretic suspension.

3. The method of claim 2, wherein step (3) further comprises, after the working electrode is taken out, controlling humidity and temperature by which the working electrode is formed, to adjust a closest packing quality of the single-layer photonic crystal structure.

4. The method of claim 2, wherein step (3) further comprises, after the working electrode is taken out, controlling a drying speed of the working electrode, to adjust a closest packing quality of the single-layer photonic crystal structure.

5. The method of claim 1, wherein the electrophoresis self-assembly technique has a working speed that is adjusted according to the distance between the working electrode and the lower electrode, an intensity of the electric field, a concentration of the electrophoretic suspension or components of the electrophoretic suspension.

6. The method of claim 1, wherein the electric field and the gravity field act at opposing directions.

7. The method of claim 1, wherein the working electrode is composed of a wafer and an electrode.

8. The method of claim 7, wherein the electrode is in a shape of a ring, a rectangle or a triangle.

* * * * *